US012685374B2

(12) United States Patent
Howes et al.

(10) Patent No.: US 12,685,374 B2
(45) Date of Patent: Jul. 21, 2026

(54) HAIR STYLING APPARATUS

(71) Applicant: Dyson Technology Limited, Malmesbury (GB)

(72) Inventors: Georgia Kate Berry Howes, Bristol (GB); John Fleming Macfadyen, Bristol (GB); Jacob Mark Parmenter, Bristol (GB); Robert Lawrence Tweedie, Chippenham (GB)

(73) Assignee: Dyson Technology Limited, Malmesbury (GB)

( * ) Notice: Subject to any disclaimer, the term of this patent is extended or adjusted under 35 U.S.C. 154(b) by 11 days.

(21) Appl. No.: 18/848,953

(22) PCT Filed: Mar. 21, 2023

(86) PCT No.: PCT/GB2023/050705

§ 371 (c)(1),
(2) Date: Sep. 20, 2024

(87) PCT Pub. No.: WO2023/187327

PCT Pub. Date: Oct. 5, 2023

(65) Prior Publication Data

US 2025/0204665 A1 Jun. 26, 2025

(30) Foreign Application Priority Data

Mar. 28, 2022 (GB) ..... 2204351

(51) Int. Cl.

| | |
|---|---|
| ***A45D 1/18*** | (2006.01) |
| ***A45D 1/00*** | (2006.01) |
| ***A45D 1/16*** | (2006.01) |

(52) U.S. Cl.
CPC ..... *A45D 1/18* (2013.01); *A45D 1/16* (2013.01); *A45D 2001/008* (2013.01)

(58) Field of Classification Search
CPC ..... A45D 1/18; A45D 1/16; A45D 2001/008; A45D 1/04; A45D 20/50; A45D 20/12;
(Continued)

(56) References Cited

U.S. PATENT DOCUMENTS

| | | | | |
|---|---|---|---|---|
| 4,341,229 | A | 7/1982 | Bauer et al. | |
| 4,936,027 | A * | 6/1990 | Tsuji | A45D 1/04 392/408 |
| 5,584,307 | A | 12/1996 | Bauer et al. | |

FOREIGN PATENT DOCUMENTS

| | | | |
|---|---|---|---|
| CN | 107242663 | A | 10/2017 |
| EP | 2789256 | A2 | 10/2014 |

(Continued)

*Primary Examiner* — Veronica Martin
(74) *Attorney, Agent, or Firm* — Tucker Ellis LLP; Michael G. Craig

(57) ABSTRACT

A hair styling apparatus for styling hair. The apparatus includes a steam generator for generating steam and one or more steam outlets in fluid communication with the steam generator for receipt of steam therefrom. The apparatus further includes an air mover for moving an airflow through the apparatus, and one or more airflow outlets in fluid communication with the air mover for receipt of an airflow therefrom. The apparatus further includes a flow diverter moveable between first and second positions. In the first position the flow diverter directs airflow to the one or more airflow outlets. In the second positions the flow diverter directs airflow to the one or more steam outlets, or to one or more further airflow outlets arranged to discharge air onto hair being styled by the apparatus in use.

12 Claims, 6 Drawing Sheets

(58) Field of Classification Search
CPC ..... A45D 2/001; A45D 20/00; A45D 20/10;
A45D 20/122
See application file for complete search history.

(56) References Cited

FOREIGN PATENT DOCUMENTS

| | | | |
|---|---|---|---|
| FR | 2726163 | A1 | 5/1996 |
| GB | 1512823 | A | 6/1978 |
| JP | H02164307 | A | 6/1990 |
| JP | H02309903 | A | 12/1990 |
| JP | H05168515 | A | 7/1993 |
| JP | H09191918 | A | 7/1997 |
| JP | 2694831 | B2 | 12/1997 |
| JP | H1094417 | A | 4/1998 |

* cited by examiner

HAIR STYLING APPARATUS

RELATED APPLICATION DATA

This application is a national phase application of International Application No. PCT/GB2023/050705 filed Mar. 21, 2023, which claims priority to GB Application No. 2204351.7 filed Mar. 28, 2022.

TECHNICAL FIELD

The present disclosure relates to a hair styling apparatus for applying steam to a user's hair.

BACKGROUND

Hair styling apparatuses, such as hair straightening devices, curlers, heated brushes, and hair dryers, can be used to form hair into a desired shape or style (e.g. by detangling, straightening, smoothing and/or curling the hair). In some cases, such devices achieve this styling by application of heat to a user's hair. This breaks chemical bonds in the hair, which allows the hair to be reshaped (i.e. into a shape other than its natural shape).

One known means for applying such heat is to use a heated surface. For example, a typical hair straightening device includes two hotplates on separate hingedly connected arms that can be pivoted together to clamp hair between the hot plates. Similarly, known curling irons include a heated barrel about which hair can be wrapped to apply curls to the hair.

Such devices rely on conduction to provide heat to a user's hair. However, because hair is an insulator, heat transfer to the centre of a tress of hair is not particularly efficient. To ensure that sufficient heat is transferred, it is necessary to heat the heated surface (e.g. hot plates or barrel) to high temperatures (e.g. above 150° C.). If not managed correctly, these high temperatures can result in heat damage to a user's hair.

An alternative to providing heat via conduction is to use steam to apply heat to a user's hair. Steam, for example, relies on convection to transfer heat to the tress of hair, which is better at ensuring uniform heat application than conduction. This means steam, which is at a lower temperature than a typical hot plate or heated barrel, can provide the same effect as (and in some cases a better effect than) a heated surface.

To maximise the styling ability of such steam devices, however, it is desirable to maximise the flow rate of the steam that is discharged by the device. Given that such devices are typically used in proximity to a user's skin (e.g. a user's scalp or hands), any use of steam presents a risk of user discomfort and, in some cases, injury. That risk inevitably increases where steam must be discharged at higher flow rates.

The present disclosure has been devised in light of the above considerations.

SUMMARY

In a first aspect there is provided a hair styling apparatus for styling a tress of hair, the apparatus comprising:

- a barrel comprising a circumferential surface about which a tress of hair can be wrapped in use,
- a steam generator for generating steam;
- one or more steam outlets in fluid communication with the steam generator for receipt of steam therefrom, the one or more steam outlets arranged to discharge steam onto a tress of hair when wrapped about the circumferential surface;
- an air mover for moving an airflow through the apparatus; and
- one or more airflow outlets in fluid communication with the air mover for receipt of an airflow therefrom, the one or more airflow outlets arranged to discharge air in a direction along the barrel so as to provide a barrier to the passage of the discharged steam.

The provision of the air from the one or more airflow outlets may protect a user from coming into contact with steam discharged from the one or more steam outlets, so as to avoid any discomfort or injury to a user of the apparatus. As the air is discharged along the barrel it will interact with steam that is discharged from the barrel (at least any steam discharged in the vicinity of the air). The discharged air mixes with steam to condense to water vapour (i.e. after the steam has passed through the hair to add energy to the hair), which reduces the amount of energy held by the steam. In this way, the air prevents direct contact between the discharged steam and a user's skin. Accordingly, the described arrangement can significantly reduce the temperatures experienced by a user of the apparatus, which increases both comfort and safety. The barrier provided by the air may, for example, be sufficient to ensure skin temperatures remain below 50° C.

Also, advantageously, steam is prevented from coming into contact with a user's skin without needing a physical barrier. Such a physical barrier would make the apparatus more cumbersome and could make it more difficult for a user to view the hair being styled (i.e. may block the user's view). Further, a physical barrier would limit a user's ability to style the hair close to the roots of the hair (because it would prevent a user from moving the barrel to the roots). More generally, contact of the physical barrier with a user's hair (e.g. movement of the physical barrier through a user's hair) could disrupt any style already applied to the hair.

For the avoidance of doubt, the reference to "along the barrel" is a reference to a direction that is along a length of the barrel (i.e. an axial direction of the barrel).

Optional features of the first aspect will now be set out. These are applicable singly or in any combination with any aspect.

The one or more airflow outlets may be configured to discharge the air in the form of an air curtain that is spaced radially from the circumferential surface. The radial spacing may mean that a space is provided between the circumferential surface and the air curtain for receipt of hair (e.g. wrapped about the barrel). In this way, the air may not be discharged directly onto the hair in use, which may help to maximise the energy imparted on the hair by the steam (and thus may maximise the ability to shape the hair).

The air curtain (i.e. in operation) may extend substantially entirely about the circumferential surface. The air curtain may be concentrically arranged with the circumferential surface. In such embodiments, the air curtain may provide a barrier to steam in all radial directions to minimise the possibility of a user coming into contact with the steam.

In other embodiments, the air curtain may extend partly about the circumferential surface. For example, the air curtain may have an arc-shaped profile (taken transversely to the direction of extension of the barrel). In such embodiments, the one or more air outlets may be configured to form the air curtain so that, in normal use, it is positioned between the apparatus and a user's scalp.

The air curtain (i.e. as produced in operation) may extend for substantially (at least) the entire length of the barrel (or the circumferential surface). That is, the air mover may be configured so as to be able to discharge air through the one or more outlets at a velocity that ensures the air flows for substantially the entire length of the barrel. This may ensure full coverage is provided by the air curtain (i.e. to maximise protection from steam).

Each airflow outlet may be configured to discharge air in an air discharge direction. The air discharge direction may be angled away from a central longitudinal axis of the barrel. This may provide radial spacing between the discharged air and the circumferential surface. As discussed above, such an arrangement may avoid air being discharged directly onto hair that is wrapped about the barrel (which could otherwise be detrimental to the styling performance of the apparatus).

The angle between the airflow discharge direction of each airflow outlet (or at least one of the airflow outlets) and the central longitudinal axis may be between 10 degrees and 50 degrees, or e.g. between 20 and 40 degrees, or e.g. about 30 degrees.

Each airflow outlet may be arranged so as to be spaced radially with respect to the circumferential surface. The radial spacing may be, for example, between 1 mm and 5 mm, or e.g. about 3 mm.

Each airflow outlet may be in the form of an aperture or slot. For example, each airflow outlet may be in the form of a circumferentially extending (e.g. arcuate) slot. Alternatively, each airflow outlet may be in the form of a linear slot, or e.g. a circular, elliptical, triangular, etc. aperture.

The or each airflow outlet may be provided at or proximate to an end of the barrel. The one or more airflow outlets may be provided on a radially extending surface of the apparatus (e.g. facing in a direction along the barrel). The radially extending surface may be obliquely oriented (i.e. may be angled/sloped with respect to both the radial and axial directions).

The apparatus may comprise a body from which the barrel extends (the body may be a handle of the apparatus that is held by a user in use). The body may be elongate. The body may be cylindrical. The body and the barrel may be coaxial. The one or more airflow outlets may be provided on the body. For example, the one or more airflow outlets may be provided on a radially extending end surface of the body (e.g. the radially extending surface discussed above may form part of the body).

In other embodiments, the one or more airflow outlets may be provided on the barrel. For example, the one or more airflow outlets may be provided on the circumferential surface.

The one or more steam outlets may be provided on the circumferential surface of the barrel. Each steam outlet may be configured to discharge air substantially radially from the circumferential surface. Each steam outlet may be configured to discharge air in a circumferential direction. Each steam outlet may be configured to discharge air in a direction along the barrel.

In some embodiments, the apparatus may comprise a plurality of steam outlets. The plurality of steam outlets may be in the form of an array of apertures (e.g. perforations) provided on the circumferential surface of the barrel. The apertures may be substantially distributed evenly across the circumferential surface. Each aperture may be e.g. circular, elliptical, triangular, etc. The plurality of steam outlets may be configured to discharge air in a diffused manner (and in this respect the steam outlets may be in the form of a diffuser).

In some embodiments, each steam outlet may be in the form of a slot. One or more of the slots may extend along the barrel (i.e. in an axial direction). One or more of the slots may extend circumferentially about the barrel.

In a second aspect there is provided a hair styling apparatus comprising:

- a body from which a plurality of spaced projections project, the projections being in the form of comb teeth or brush bristles for passing through a user's hair to style the hair;
- a steam generator for generating steam;
- one or more steam outlets in fluid communication with the steam generator for receipt of steam therefrom, the one or more steam outlets arranged to discharge steam onto hair through which the projections are passed in use;
- an air mover for moving an airflow through the apparatus; and
- one or more airflow outlets in fluid communication with the air mover for receipt of an airflow therefrom, the one or more airflow outlets arranged to discharge air at or proximate to the discharged steam so as to provide a barrier to the passage of the steam.

The provision of steam from a device that includes comb teeth or brush bristles (and that is therefore able to function in the manner of a comb or brush) can improve the styling ability of the apparatus. As an example, the application of steam to hair that is tangled can aid in relaxing the hair and thus can facilitate detangling of the hair by the teeth or bristles of the apparatus. Similarly, the relaxation of the hair can substantially reduce the pull force on the hair, making the detangling process more comfortable for a user.

As provided above with respect to the first aspect, the provision of the air from the one or more airflow outlets may protect a user from coming into contact with steam discharged from the one or more steam outlets, so as to avoid any discomfort or injury to a user of the apparatus. As the air is discharged it will interact with steam that is discharged from the apparatus. The discharged air mixes with steam to condense to water vapour, which reduces the amount of energy held by the steam. In this way, the air prevents direct contact between the discharged steam and a user's skin. Accordingly, the described arrangement can significantly reduce the temperatures experienced by a user of the apparatus, which increases both comfort and safety (while providing enhanced styling ability due to the presence of the steam). The barrier provided by the air may, for example, be sufficient to ensure skin temperatures remain below 50° C.

Also, advantageously, and as discussed above, steam is prevented from coming into contact with a user's skin without needing a physical barrier. Such a physical barrier would make the apparatus more cumbersome and could make it more difficult for a user to view the hair being styled (i.e. may block the user's view). As set forth above, the presence of a physical barrier would also limit the ability of user to style the roots of their hair, and could cause disruption to any style already applied to the hair.

Optional features of the second aspect will now be set out. These are applicable singly or in any combination with any aspect.

The one or more steam outlets may be provided on the body. For example, the one or more steam outlets may be provided at or proximate to a portion of the body from which the projections project. Each projection may have a proximal end proximate the body, and an opposite distal end that is distal from the body. The one or more steam outlets may be proximate to the proximal ends of the projections.

The one or more steam outlets may be arranged to discharge steam in the direction of extension of the plurality of projections from the body. That is, the one or more steam outlets may be arranged to discharge steam along the length of one or more of the projections.

The one or more steam outlets may be arranged to discharge steam into spaces formed between the projections. In use, hair may be received in the spaces formed between the projections. Thus, the one or more steam outlets may be arranged to discharge steam onto the hair in the spaces. As may be appreciated, in such embodiments, the one or more steam outlets may thus be arranged such that they discharge steam across a width of a tress of hair through which the projections extend (the width being perpendicular to the direction of the extension of the tress of hair from a user's head).

The one or more airflow outlets may be arranged to discharge air in a direction across the distal ends of the projections. For example, the one or more airflow outlets may be configured to discharge air to form an air curtain that intersects the distal ends of the projections or that is proximate (but spaced from) the distal ends of the projections. In either case, the air curtain may provide a barrier to the flow of steam beyond the distal ends of the projections (or at least for any significant distance beyond the distal end so the projections).

In embodiments where the projections are in the form of a row of comb teeth, the one or more airflow outlets may be arranged to discharge air in a direction that is parallel to the direction of the row (e.g. if the row extends transversely, then the discharge direction may be the transverse direction).

In some embodiments, the one or more airflow outlets may be arranged to discharge air in the direction of extension of the plurality of projections from the body. Thus, both the one or more airflow outlets and one or more steam outlets may discharge air/steam in the same direction. The one or more airflow outlets may be disposed so as to extend at least partly about a periphery of the one or more steam outlets. For example, the steam outlet may be in the form of a slot and may be interposed between two or more airflow outlets (which may be in the form of slots) or two or more portions of a single airflow outlet. The one or more airflow outlets may be disposed so as to extend substantially fully about a periphery of the one or more steam outlets. In such embodiments, the one or more airflow outlets may form an air curtain that acts as a peripheral barrier to the discharged steam (i.e. limiting any flow of the steam in a direction perpendicular to the direction in which it is discharged).

In some embodiments, each airflow outlet may be provided on a respective projection of the plurality of projections. For example, each projection may comprise a respective airflow outlet.

Each projection may comprise a plurality of respective airflow outlets. Each airflow outlet may be provided at or proximate to a distal end of a respective projection of the plurality of projections.

In such embodiments, the one or more airflow outlets provided on each projection may be arranged to discharge airflow away from the projection and, optionally, in a direction of extension of the projection. The one or more airflow outlets provided on each projection may be arranged to discharge airflow in a divergent manner (i.e. so as to form a jet or flow of air that diverges from the projection). Such embodiments may be particularly suited to arrangements in which the projections are provided in the form of an array of brush bristles. Where there is a plurality of airflow outlets on each projection, this may be achieved by orienting the outlets in a divergent manner. Where a single airflow outlet is provided on each projection, the divergent discharged airflow may be achieved by providing an airflow outlet in the form of a nozzle.

In embodiments in which the projections are in the form of a row of spaced comb teeth, each tooth may extend from the body in a longitudinal direction. Each tooth may comprise laterally spaced and longitudinally extending leading and trailing edges. The leading edge may lead in movement through a user's hair in normal use. Similarly, the trailing edge may trail in movement through a user's hair in normal use.

Each steam outlet may be provided on a tooth of the row of comb teeth. Each steam outlet may be provided on the leading edge of a tooth of the row of comb teeth. Such an arrangement may be beneficial in an apparatus used for detangling a tress of hair. By positioning the one or more steam outlets on leading edges of the teeth, the steam outlets may discharge steam onto hair that has not yet passed between the teeth and that may therefore be in a tangled state. Discharging steam onto this portion of a tress of hair may help to relax the hair and facilitate detangling of the hair as it subsequently passes through the teeth.

Each steam outlet may be arranged to discharge steam in a lateral direction away from the leading edge on which it is disposed. Each steam outlet may be arranged to discharge steam in a direction that is substantially perpendicular to the leading edge and/or substantially perpendicular to the direction of extension of the respective projection. In other words, each steam outlet may be arranged to discharge steam in a forward direction (i.e. a direction of movement of the apparatus in normal use along a tress of hair).

Each of the one or more airflow outlets may be provided on a leading edge of a tooth of the row of comb teeth on which one of the steam outlets is provided. Each tooth may comprise at least one airflow outlet and at least one steam outlet. The (or each) airflow outlet of each tooth may be disposed distally of at least one steam outlet of the same tooth. That is, where a tooth includes both an airflow outlet and a steam outlet, the airflow outlet may be disposed closer to the distal end than the steam outlet. For example, the airflow outlet may be disposed at or proximate to the distal end and the steam outlet may be provided in a central region (i.e. generally centrally between the proximal and distal ends of the tooth).

When provided on a tooth, each airflow outlet may be arranged to discharge airflow laterally and away from the leading edge of the tooth on which it is provided. That is, each airflow outlet may be arranged to discharge air in a direction that is substantially perpendicular to the leading edge and/or substantially perpendicular to the direction of extension of the respective projection. In other words, each airflow outlet may be arranged to discharge air in a forward direction (i.e. a direction of movement of the apparatus in normal use along a tress of hair).

Alternatively, when provided on a tooth, each airflow outlet arranged to discharge air towards the body. Each airflow outlet may be arranged to discharge air in a direction towards the proximal end of the tooth on which it is provided. The airflow outlets may be arranged to form an air curtain that is spaced forwardly of (but extends in a direction across) the steam outlets. For example, each airflow outlet may be provided on a forwardly extending hook portion of a respective tooth (e.g. on an underside of the hook portion). Each airflow outlet may be arranged to direct air in a direction that forms an angle with the leading edge of the tooth on which the airflow outlet is provided. For example, each tooth may extend from the body in a direction that is angled with respect to a central axis of the body (i.e. may be arranged on a slope) and each airflow outlet may be arranged to discharge air in a direction that is parallel to the central axis of the body.

Optional features of the first and second aspects will now be set out. These are applicable singly or in any combination with any aspect.

In some embodiments, the apparatus may comprise a flow diverter moveable between first and second positions. In the first position, the flow diverter may direct airflow to the one or more airflow outlets. In the second position the flow diverter may direct airflow to the one or more steam outlets. Alternatively or additionally, in the second position, the flow diverter may direct airflow to one or more further airflow outlets arranged to discharge airflow onto hair being styled by the apparatus in use.

The provision of the flow diverter that is able to operate in this manner allows the air mover to provide dual functionality (i.e. providing an airflow curtain or providing a hair-cooling airflow). Thus, a more versatile apparatus is provided without significantly increasing the complexity or size of the apparatus.

The apparatus may be configured to operate in first and second modes. In the first mode, steam may be discharged from the one or more steam outlets and air may be discharged from the one or more airflow outlets. In other words, in the first mode, air and steam may be discharged concurrently. This may represent a normal operating mode of the apparatus. In the second mode, steam may not be discharged from the one or more steam outlets. Additionally, in the second mode, airflow may be discharged from the steam outlets or from the one or more further airflow outlets.

In a third aspect there is provided a hair styling apparatus for styling hair, the apparatus comprising:

- a steam generator for generating steam;
- one or more steam outlets in fluid communication with the steam generator for receipt of steam therefrom, the one or more steam outlets arranged to discharge steam onto hair being styled by the apparatus in use;
- an air mover for moving an airflow through the apparatus; and
- one or more airflow outlets in fluid communication with the air mover for receipt of an airflow therefrom, the one or more airflow outlets arranged to discharge air at or proximate to the discharged steam so as to provide a barrier to the passage of the steam; and
- a flow diverter moveable between:
- a first position in which the flow diverter directs airflow to the one or more airflow outlets; and
- a second position in which the flow diverter directs airflow to the one or more steam outlets, or to one or more further airflow outlets arranged to discharge air onto hair being styled by the apparatus in use.

As has been set forth above with respect to the first and second aspects, the provision of airflow outlets allows a barrier to be formed to prevent (or at least provide a limit to) steam contacting a user's skin. In the third aspect, the provision of a flow diverter provides the apparatus with additional functionality. In particular, it allows a single air mover to provide airflow for both cooling hair to set a hair style, and for providing a barrier to steam contacting a user's skin (depending on the position of the flow diverter). Thus, the apparatus provides this dual functionality in a simplified manner (thereby minimising the complexity of the apparatus).

Optional features of the third aspect will now be set out. These are applicable singly or in any combination with any aspect.

The apparatus may be configured to operate in a first mode and a second mode. In the first mode, steam may be discharged from the one or more steam outlets and the flow diverter may be in the first position. In the second mode, steam may be discharged from the one or more steam outlets and the flow diverter may be in the second position.

The apparatus may comprise a barrel having a circumferential surface. The apparatus of the third aspect may, for example, be as defined with respect to the first aspect (and may include one or more optional features of the first aspect). The one or more further airflow outlets may be provided on the circumferential surface of the barrel.

The apparatus may comprise a body from which a plurality of spaced projections project. The projections may be in the form of comb teeth or brush bristles for passing through a user's hair to style the hair. The apparatus of the third aspect may, for example, be as defined with respect to the second aspect (and may include one or more optional features of the second aspect).

Optional features of the first, second and third aspects will now be set out. These are applicable singly or in any combination with any aspect.

In either of the first, second and third aspects described above, the steam generator may be configured to provide a steam flow rate of more than 1 g/min, or more than 3 g/min or more than 5 g/min. The steam generator may be configured to provide a steam flow rate of less than 20 g/min, or less than 15 g/min, or less than 10 g/min. For example, the steam generator may be configured to provide a steam flow rate of between 3 and 15 g/min, or e.g. 5 and 10 g/min.

In either of the first, second and third aspects, the device (e.g. the air mover) may be configured to discharge airflow through the one or more airflow outlets at a flow rate of between 1 and 20 L/s, or between 3 and 15 L/s, or between 6 and 10 L/s.

The apparatus may be configured such that the airflow discharged from the one or more airflow outlets is provided substantially at or below ambient temperature. In other words, the apparatus may be configured to provide a substantially unheated airflow (i.e. one that is not actively heated by a heater) from the one or more airflow outlets. As should be appreciated, heating the airflow would be detrimental to the ability of the airflow to provide a barrier to the steam.

The apparatus may be configured to discharge steam from the one or more steam outlets and air from the one or more airflow outlets concurrently. For example, the apparatus may comprise a controller configured to control the steam generator and the air mover to be activated at the same time. In some embodiments, the apparatus may be configured to always discharge airflow from the one or more airflow outlets when steam is being discharged from the one or more steam outlets (i.e. ensuring that steam cannot be discharged without the presence of an air barrier).

The apparatus may comprise a controller (e.g. comprising a microcontroller) for controlling the apparatus. The controller may be operatively connected to one or more of the air mover, steam generator and flow diverter. The controller may be configured to control the device to enter the first and second modes as described above. The controller may be configured to control the flow diverter to move the flow diverter between the first and second positions as described above.

In some embodiments the apparatus may comprise a user interface (e.g. a switch, button, touch screen, etc.) operatively connected to the controller. The controller may be configured to control the apparatus (e.g. the flow diverter) in response to an input received from the user interface. The controller may be configured to control the device to enter the first or second mode in response to an input received from the user interface.

BRIEF SUMMARY OF THE FIGURES

Embodiments will now be discussed with reference to the accompanying figures in which.

DETAILED DESCRIPTION

Aspects and embodiments will now be discussed with reference to the accompanying figures. Further aspects and embodiments will be apparent to those skilled in the art.

Figure 1:
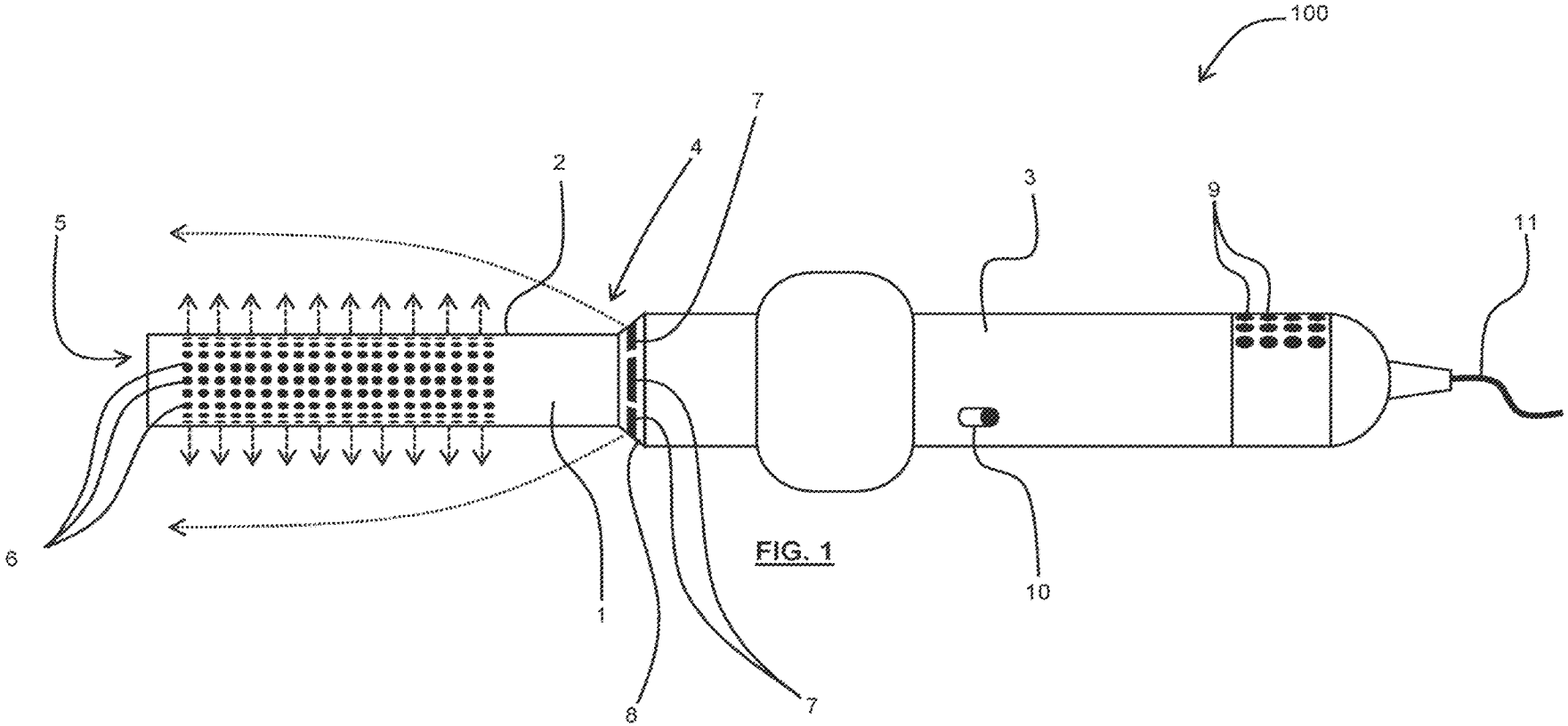
FIG. 1 is a side view of a hair styling apparatus according to a first embodiment.

FIG. 1 illustrates a hair styling apparatus 100 for styling a tress of hair (not shown). The apparatus 100 comprises an elongate cylindrical barrel 1 comprising a circumferential surface 2 about which a tress of hair can be wrapped in use (for example, to curl the hair). The barrel 1 extends axially from an end of a cylindrical body 3 of the apparatus 100, which is greater in diameter than the barrel 1 and which defines a handle of the apparatus 100 (that is held in a user's hand in use). The barrel 1 thus has a proximal end 4 that is adjacent the body 3, and an opposite distal end 5 that is distal from the body 3 and that represents a free end of the barrel 1.

The body 3 houses a steam generator (not shown in FIG. 1) for generating steam. The steam generator may, for example, be in the form of a boiler comprising a heater (such as a resistance heater). The steam generator is in fluid communication with a plurality of steam outlets 6 (e.g. by way of a steam passage), which receive, and then discharge, steam from the steam generator in operation of the apparatus 100. The steam outlets 6 are in the form of an ordered array of circular perforations provided on the circumferential surface 2 of the barrel 1.

Each steam outlet 6 discharges steam in a radial direction (perpendicular to the axis along which the barrel 1 extends, as depicted by the dashed lines in FIG. 1) such that the air passes through hair that is wrapped about the circumferential surface 2. To maximise the coverage provided by the steam outlets 6, they cover a substantial portion of the circumferential surface 2 of the barrel 1. Accordingly, in use, a user can wrap a tress of hair about the barrel 1 and steam discharged from the outlets 6 will add energy to the hair so as to improve the ability to reshape the hair. Typically, such reshaping will be in the form of curls being provided in the tress of hair due to the coiled nature of the hair when wrapped about the barrel.

As may be appreciated, discharging steam from any handheld device presents a risk that a user may come into contact with the steam, which could cause discomfort. To eliminate (or at least reduce) this risk, the present apparatus 100 includes a plurality of airflow outlets 7 that discharge air in a direction along the barrel 1 (as illustrated by the dotted lines in FIG. 1) so as to provide a barrier to the passage of the steam discharged from the steam outlets 6. The airflow outlets 7 are provided at the distal end 4 of the barrel 1, on a radially extending end wall 8 of the body 3 that connects the body 3 to the circumferential surface 2.

Each airflow outlet 7 is a circumferentially extending arcuate slot. As a result, the air discharged by the airflow outlets 7 forms an annular air curtain (i.e. a layer of air) that extends circumferentially about the barrel 1. In this way, steam that is discharged from the steam outlets 6 and that passes through hair wrapped about the barrel 1 interacts with the air curtain formed by the airflow outlets 7. In particular, the discharged air mixes with the steam to condense to water vapour, which reduces the amount of energy held by the steam. In this way, the air prevents direct contact between the discharged steam and a user's skin. This significantly reduces the temperatures experienced by a user of the apparatus, which increases both comfort and safety.

The end wall 8 on which the airflow outlets 7 are provided is sloped. As a result, the airflow outlets 7 are arranged on an angle and air discharged therefrom is discharged in a direction (referred to herein is as the air discharge direction) that is angled away from the central longitudinal axis of the barrel 1 by approximately 45 degrees. One consequence of this is that a space is formed between the circumferential surface 2 of the barrel and the air curtain. Accordingly, the discharged air is not discharged directly onto hair that is wrapped about the barrel 1. This ensures that the discharged air is able to flow to the end of the barrel (i.e. to provide maximum protection), and also minimises any cooling of the wrapped hair by the discharged air, which could counteract the effects provided by the steam.

To provide the discharged air, the apparatus 100 includes an air mover (not shown in FIG. 1), which may be in the form of a fan or pump. The air mover is in fluid communication with the airflow outlets 7 (which are downstream of the air mover) and with a plurality of airflow inlets 9 (upstream of the air mover), which are provided at an opposite end of the body 3 to the barrel 1.

An airflow passage within the body 3 may connect the airflow inlets 9, air mover, and airflow outlets 7.

Both the air mover and the steam generator are powered via a cable 11 extending from the end of the body 3, which can be connected to a mains power supply. A user is able to control the provision of power to these components using a switch 10 provided on an external surface of the body 3.

Figure 2A:
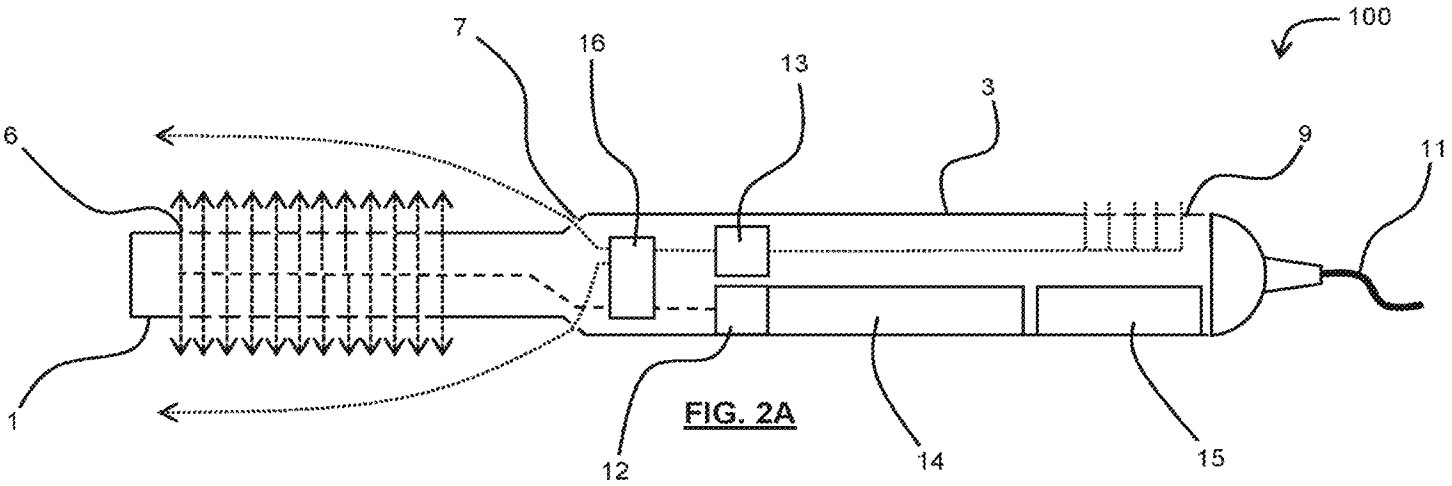
FIGS. 2A and 2B are schematic views of the first embodiment in first and second modes of operation.
Figure 2B:
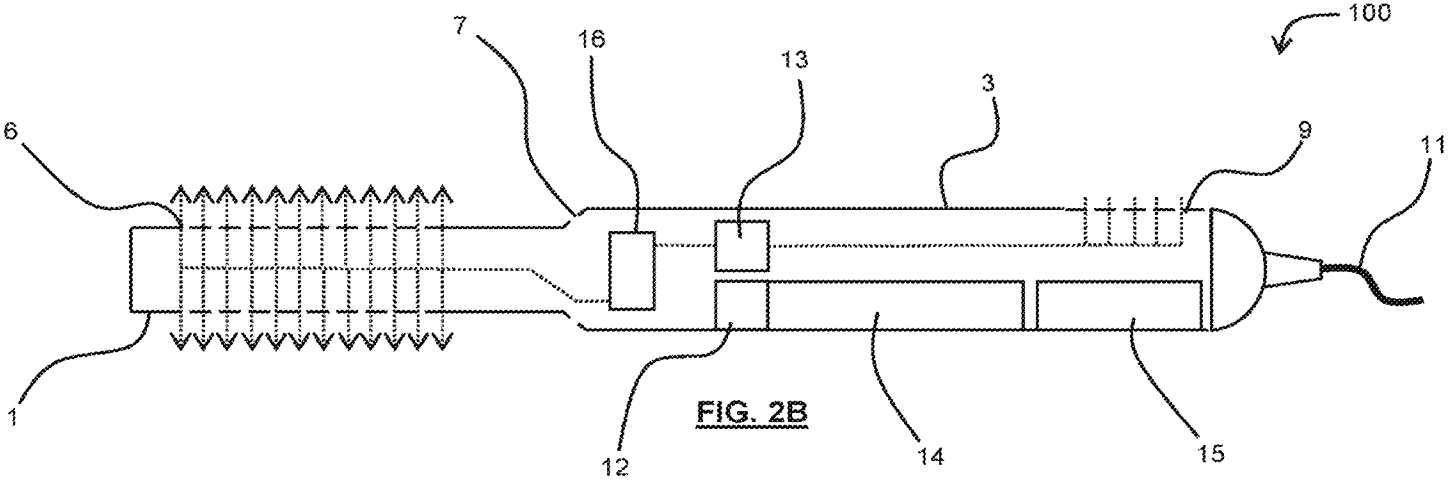

FIGS. 2A and 2B schematically illustrate operation of the apparatus 100 of FIG. 1. Each of these shows the steam generator 12 and air mover 13 mentioned above with reference to FIG. 1. Also illustrated is a reservoir 14, controller 15, and flow diverter 16, which will each be described in further detail below.

The reservoir 14 is configured to hold water and is fluidly connected to the steam generator 12 for supplying water to the steam generator 12 (for heating by the steam generator 12).

Although not illustrated, a pump may be provided for moving water from the reservoir 14 to the steam generator 12. As may be appreciated, the flow rate of steam discharged from the steam outlets 6 may be controlled by controlling the flow rate of the pump. The reservoir may be refillable via an inlet opening and/or may be removable from the body 3 for refilling.

The flow diverter 16 is in fluid communication with, and downstream of, each of the steam generator 12 and the air mover 13. The flow diverter 16 is moveable between two positions as illustrated in FIGS. 2A and 2B, which will be discussed further below. The flow diverter 16 may, for example, be in the form of a valve, or a plurality of operatively connected valves.

The controller 15 controls the flow diverter 16 (to move it between the two positions), the steam generator 12, and the air mover 13, in response to input received from the switch 10 (show in FIG. 1).

In the first position, as shown in FIG. 2A, the flow diverter 16 directs airflow (received from the air mover 13) to the airflow outlets 7. At the same time, steam is generated by the steam generator 12 and flows to the steam outlets 6 so as to be discharged through the steam outlets 6. This position represents the normal operating mode of the apparatus 100 as shown in FIG. 1. Thus, in this mode, steam is discharged radially from the barrel 1 and air is discharged along the barrel to provide a barrier to the steam. A user will use this mode (which is selected via the switch 10) to apply heat to hair that is wrapped about the barrel 1.

In the second position, as shown in FIG. 2B, the flow diverter 16 directs airflow (received from the air mover 13) to the steam outlets 6. In this position, air, rather than steam, is discharged through the steam outlets 6 on the barrel 1 and no air or steam is discharged through the airflow outlets 7. Accordingly, when the flow diverter 16 is in this second position, the controller 15 deactivates the steam generator 12 (such that no steam is discharged by the apparatus 100). This mode represents a cooling mode of the apparatus 100. In this mode, a user can cool the styled hair wrapped about the barrel 1 in order to "set" the style (i.e. cause the shape of the reshaped hair to be retained).

As may be appreciated, the second mode may be achieved in other ways. For example, the air may be diverted by the flow diverter 16 to further airflow outlets directed at a tress of hair wrapped about the barrel 1 (e.g. the further airflow outlets may be disposed on the barrel 1).

The provision of the flow diverter 16 allows the air mover 13 to provide dual functionality (i.e. providing an airflow curtain or a hair-cooling airflow as described above). Thus, a more versatile apparatus is provided without significantly increasing the complexity or size of the apparatus.

In the apparatus 100 described above, hair is styled by wrapping it about the barrel 1 of the apparatus 100. As may be appreciated, at least some of the features present in this apparatus 100 are applicable to other types of hair styling apparatus. FIGS. 3 to 8 describe further embodiments in which steam is discharged along with an airflow to provide a barrier to the steam. As these embodiments include many of the same features as FIGS. 1, 2A and 2B, the same reference numerals have been used where appropriate. Similarly, like FIGS. 1, 2A and 2B, airflow is depicted using dotted lines and steam is depicted using dashed lines in FIGS. 3 to 8.

Figure 3:
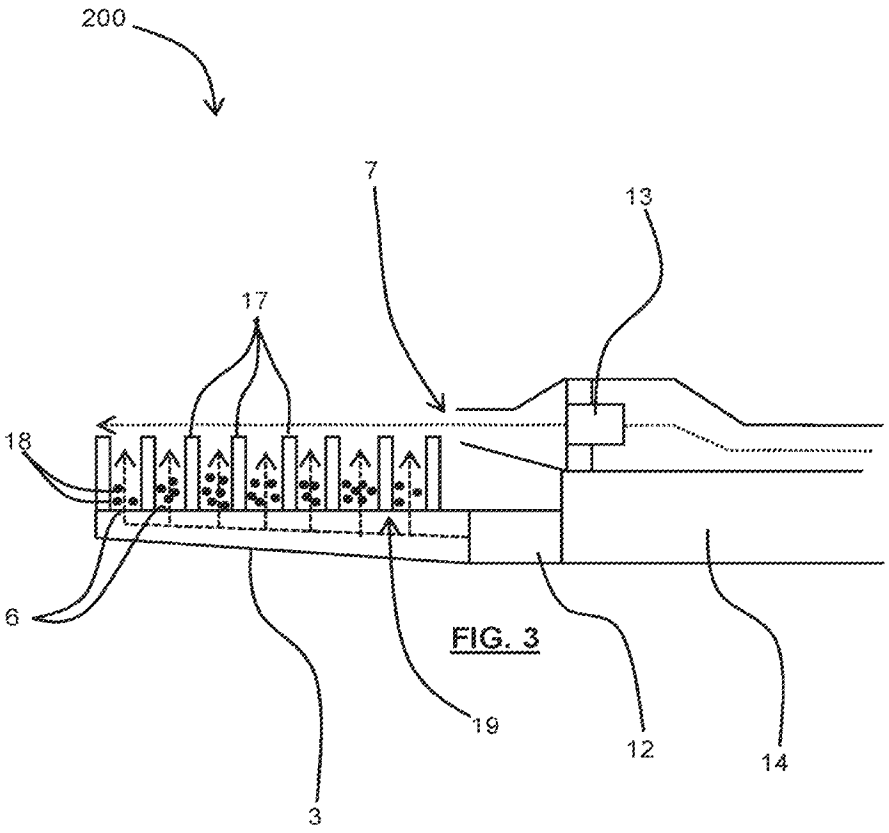
FIG. 3 is a schematic view a hair styling apparatus according to a second embodiment.

The apparatus 200 schematically illustrated in FIG. 3 comprises a body 3 from which a plurality of spaced projections 17 project (generally perpendicularly to an elongate extension of the body 3). In the illustrated form, these projections 17 are in the form of comb teeth (e.g. rigid teeth) aligned in a row, but could otherwise be brush bristles (e.g. flexible bristles). In this embodiment, the steam outlets 6 are arranged on the body 3 adjacent proximal ends 19 (proximal the body 3) of the projections 17. In particular, the steam outlets 6 are arranged between the projections 17 and are configured so as to discharge steam in the direction of extension of the projections 17, into the spaces formed between the projections 17. As may be appreciated, in use, hair 18 (illustrated in cross-section in FIG. 3) is received between the projections, such that steam is discharged from the steam outlets 6 onto the hair 18.

The apparatus 200 also includes an airflow outlet 7 that is arranged so as to discharge air in a direction across the distal ends 20 of the projections 17. This forms an air curtain that extends across the distal ends 20 of the projections 17 so as to provide a barrier to the steam discharged from the steam outlets 6. In particular, the air curtain prevents steam from travelling beyond the ends of the projections 17 (which prevents the steam from coming into contact with a user's scalp).

Figure 4:
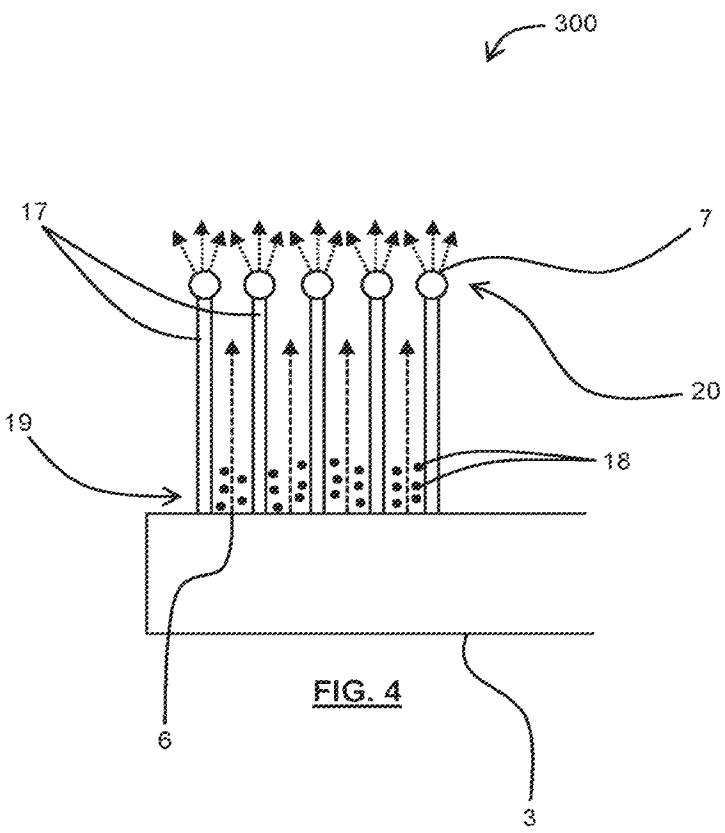
FIG. 4 is a schematic view a hair styling apparatus according to a third embodiment.

In FIG. 4, the apparatus 300 also includes projections 17, which in this case are in the form of an array of brush bristles (but could otherwise be in the form of comb teeth). The projections 17 project from a body 3 in a direction that is perpendicular to an elongate extension of the body 3. The body 3 is provided with a plurality of steam outlets 6 that are in fluid communication with a steam generator (not shown). The steam outlets 6 are disposed at proximal ends 19 of the projections 17 so as to direct steam in a direction that is parallel with the projections 17 and into spaces formed between the projections 17. In use, hair is received in these spaces, such that the steam is directed onto the hair.

The apparatus 300 is also provided with a plurality of airflow outlets 7, which are disposed on the projections 17. In particular, each projection 17 includes a plurality of airflow outlets 7 disposed at a distal end 20 thereof. Although not shown, each projection 17 includes an internal passage that provides fluid communication between the airflow outlets 7 and an air mover (not illustrated).

The airflow outlets 7 of each projection 17 are arranged so as to direct air in diverging directions. As may be appreciated, a similar effect could be provided with a single airflow outlet 7 on each projection in the form of a nozzle (creating a diverging airflow). One consequence of this arrangement is that an air curtain is generated that extends across the distal ends 20 of the projections 17. Much like the apparatus 200 of FIG. 3, this air curtain helps to prevent steam (discharged from the steam outlets 6) from flowing past the distal ends of the projections 17. Again, this ensure that the steam does not come into contact with a user's skin. As may be appreciated, where a user's skin is disposed in proximity to the distal ends of the projections 17, the air discharged from the air outlets 7 may be trapped between the skin and the projections 17, which may facilitate formation of the air curtain (i.e. air layer).

Figure 5B:
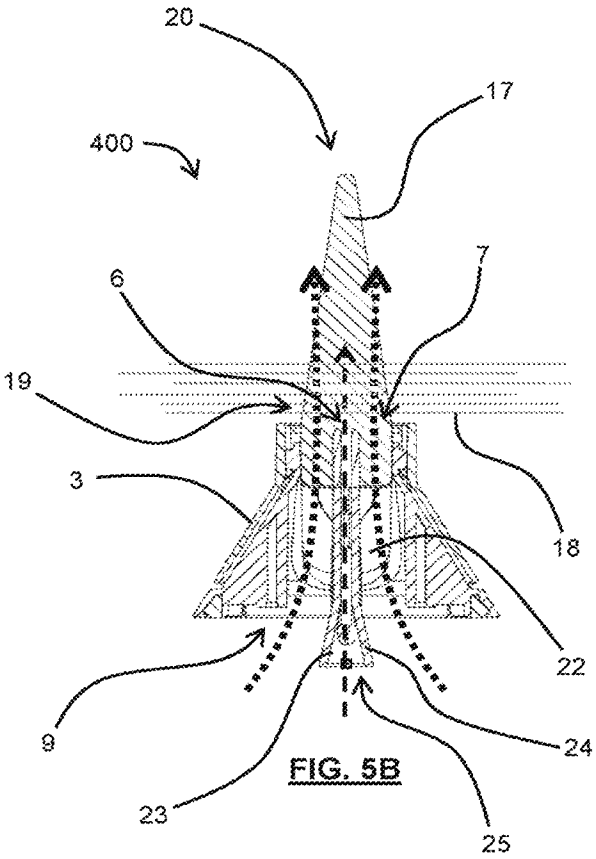
FIGS. 5A and 5B are respective perspective cutaway and side section views of a hair styling apparatus according to a fourth embodiment.
Figure 5A:
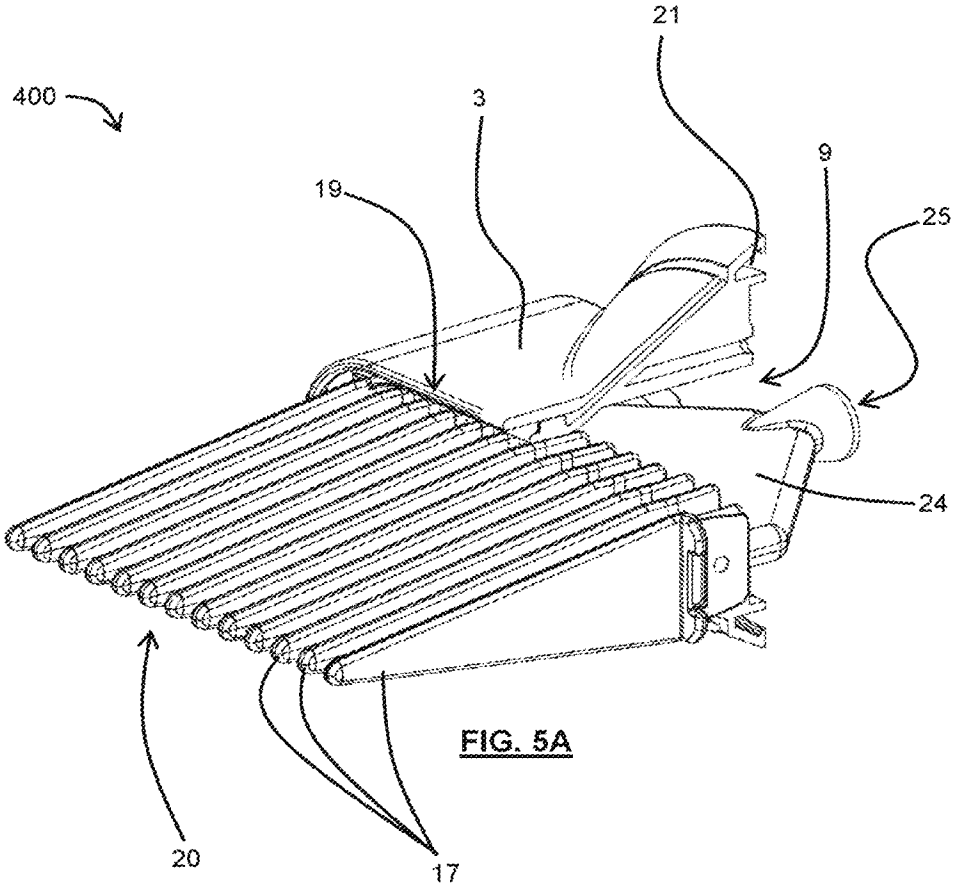

FIGS. 5A and 5B depict a further apparatus 400, which is in the form of a wide tooth comb attachment for a device capable of generating both steam and an airflow. The apparatus 400 includes a body 3 (or housing) that includes a mounting portion 21, in the form of an annular groove, for mounting to a device.

The apparatus 400 includes a plurality of projections 17 in the form of a row of spaced comb teeth that project from the body 3. Each projection 17 has a triangular shape, so as to taper from a wider proximal end 19 (proximate the body 3) to a narrower distal end 20 (distal from the body 3).

The row of projections 17 extends transversely across an airflow outlet 6 of the apparatus 400 that is defined by a rectangular opening in an end of the body 3. In particular, the airflow outlet 7 forms part of an airflow passage 22 that extends through the body 3 from an airflow inlet 9. When mounted to a device, the airflow inlet 9 is in fluid communication with an air mover that moves air along the airflow passage 22 form the inlet 9 to the airflow outlet 7.

Also provided is a steam flow passage 23, defined within a steam flow duct 24, that fluidly connects a steam inlet 25 to a steam outlet 6. The steam inlet 25 is circular and receives steam from the steam generator of a device when the apparatus 400 is mounted thereto. The steam flow passage 23 and steam flow duct 24 diverge in the transverse direction from the steam inlet 25 to the steam outlet 6. As a result, the steam outlet 6 has an elongate shape (i.e. is in the form of a slot) and is elongate in a direction along the transverse axis (i.e. the axis along which the row of projections 17 extends).

Each of the steam outlet 6 and the airflow outlet 7 direct steam/air respectively in a direction that is parallel to the direction of extension of the projections 17 from the body. As is particularly apparent from FIG. 5B, the airflow passage 22 surrounds the steam flow duct 24. In a similar manner, the airflow outlet 7 extends about a periphery of the steam outlet 6. Accordingly, the steam discharged by the steam outlet 6 forms a blade that extends centrally along the row of projections 17 and that is interposed between two air curtains that also extend (transversely) along the row of projections 17. In this way, the steam is discharged onto hair 18 received between the projections 17, and the air curtains provide a barrier to steam travelling forward or rearward of the projections 17 (i.e. in directions that are perpendicular to the direction of extension of each projection 17).

Figure 6A:
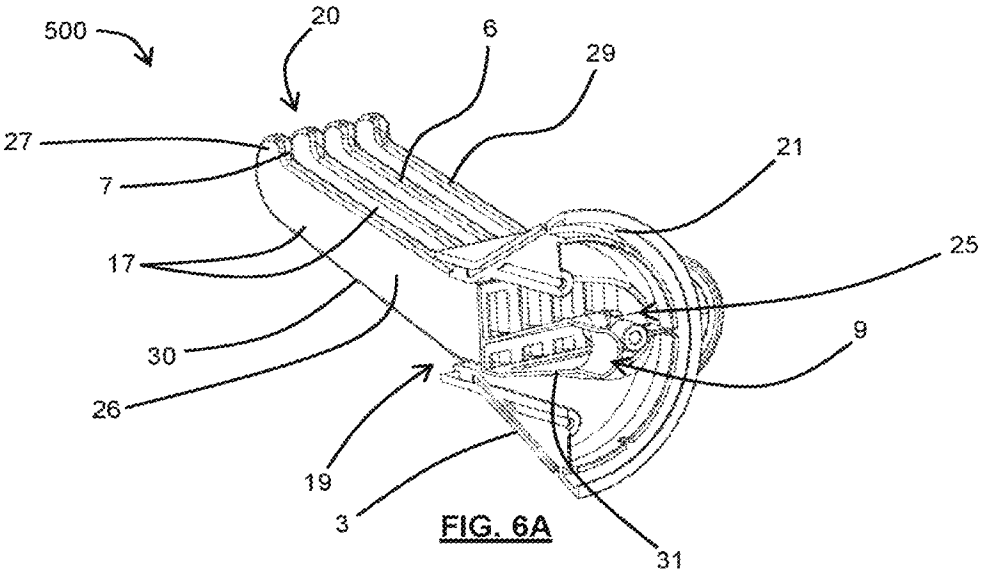
FIGS. 6A, 6B and 6C are respective perspective cutaway, perspective, and side section views of a hair styling apparatus according to a fifth embodiment.
Figure 6B:
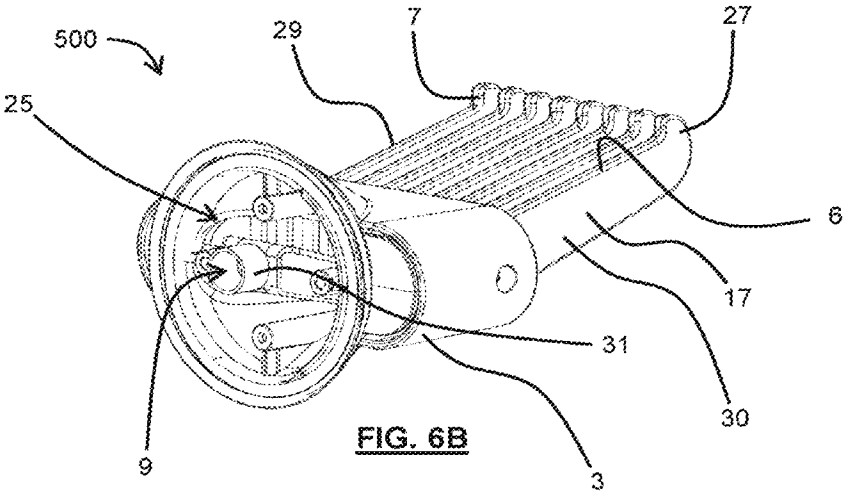
Figure 6C:
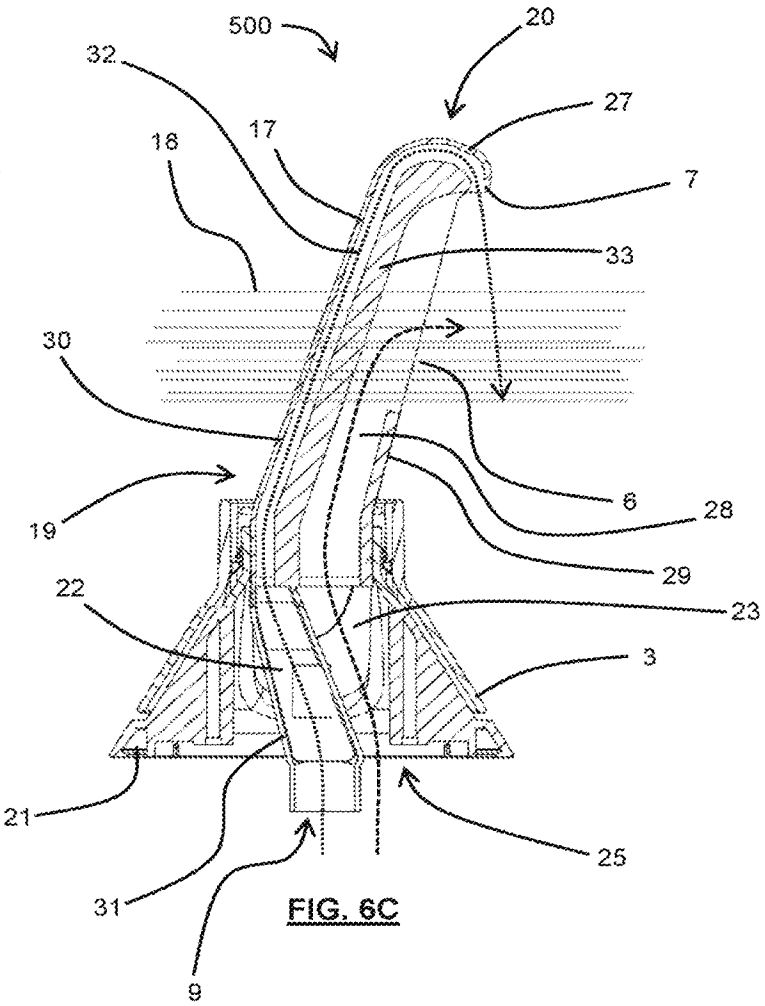

The apparatus 500 of FIGS. 6A, 6B and 6C is also in the form of an attachment for mounting to a device that is capable of supplying an airflow and steam to the apparatus 500. The apparatus 500 includes a mounting portion 21 in the form of an annular groove for mounting to such a device.

Like the previously described embodiment, the apparatus 500 includes a plurality of projections 17 that are in the form of a row of spaced comb teeth. Each projection 17 extends from a body 3 of the apparatus 500 so as to be angled away from a central axis of the body 3, and is formed of a primary portion 26 that forms a main body of the projection 17 and a secondary hook portion 27 that extends laterally at the distal end 20 of the projection 17. The direction of extension of the hook portion 27 is the same as the direction in which the projection 17 is angled away from the central axis of the body 3.

In normal use, the hair in a tress of hair is received in spaces defined between the projections 17 and the apparatus 500 is moved along the tress of hair to style the hair, and in some cases detangle the hair. Accordingly, each projection 17 includes opposed and spaced longitudinally extending leading 29 and trailing 30 edges. The leading edges 29 lead in movement along a tress of hair and the trailing edges 30 trail in movement along a tress of hair in normal use. It should be appreciated, however, that this does not mean that the apparatus 500 is incapable of being used in the opposite direction (i.e. with the leading edges 29 trailing and the trailing edges 30 leading in movement).

The body 3 defines a primary steam flow passage 23 that extends from a steam inlet 25, and each projection 17 defines an internal secondary steam flow passage 28. Each secondary steam flow passage 28 is connected at one end to (so as to receive steam from) the primary steam flow passage 23 and at an opposing end includes a steam outlet 6. In particular, each steam outlet 6 is provided on the leading edge 29 and is elongate (i.e. is a slot) in a direction along the length of the projection 17 (i.e. is elongate along the leading edge 29). As a result, steam is discharged from each steam outlet 6 in a forward direction from the respective projection 17 (i.e. in a direction that is substantially perpendicular to the leading edge 29).

Thus, in operation, steam (received from a device to which the apparatus 500 is mounted) passes through a steam inlet 25, along the primary steam flow passage 23, through the secondary steam flow passages 28 and is then discharged from the steam outlets 6 along a tress of hair along which the apparatus 500 is being moved. In particular, the steam is discharged onto a portion of the tress of hair that has not passed between the projections 17 (and has thus not yet been styled by the projections 17). By discharging steam onto this portion of a tress of hair, the hair may be relaxed by the heat of the steam, which can aid in detangling of the hair as it subsequently passes between the projections 17.

The body 3 also houses an airflow duct 31 that defines a primary airflow passage 22 extending from an airflow inlet 9 (which receives airflow from a device when the apparatus 500 is mounted thereto). Each projection 17 defines a secondary airflow passage 32 that connects, at one end, to the primary airflow passage 22 and includes, at an opposite end, an airflow outlet 7. Each secondary airflow passage 32 is separated from a respective secondary steam flow passage 23 of the same projection 17 by a separator wall 33 interposed therebetween (with the secondary airflow passage 32 being positioned towards the trailing edge 30 and the secondary steam flow passage 23 being positioned towards the leading edge 29).

The airflow outlet 7 of each projection 17 is disposed on an underside of the hook portion 27 of the projection 17. In this way, each airflow outlet 7 is arranged to discharge air in a direction towards the body 3 and across the steam outlet 6 of the same projection 17. In this way, the airflow outlets 7 form an air curtain that extends across the steam outlets 6, so as to provide a barrier to the passage of steam away from the apparatus 500 and towards a user's skin. That is, the air curtain helps to delimit a region (between the air curtain, the body 3 and the projections 17) in which steam is contained. This region is provided because each airflow outlet 7 is spaced in a forward direction with respect to the steam outlet 6 of the same projection 17. This is because of the slope of each projection 17 and because each projection is provided with the forwardly extending hook portion 27 on which the airflow outlets 7 are provided.

Figure 8:
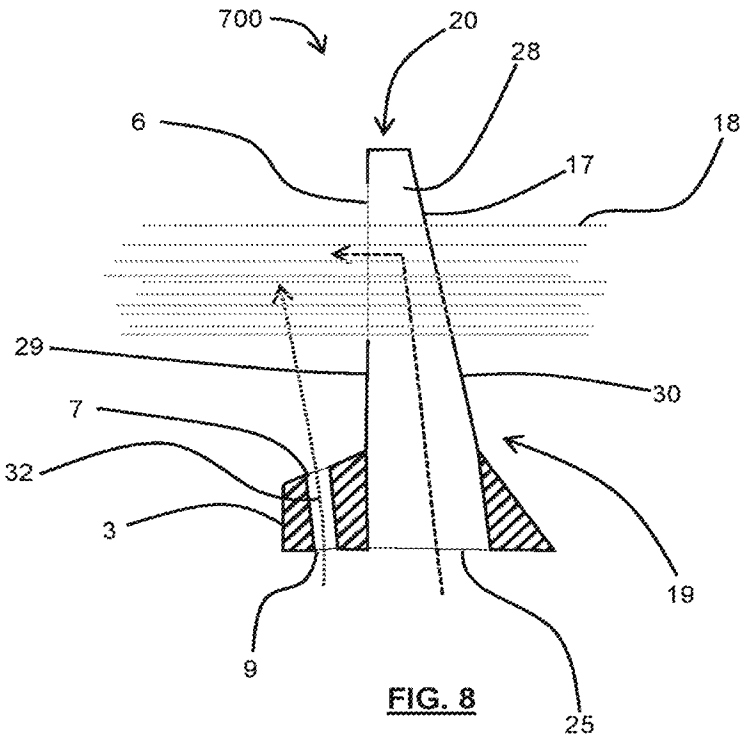
FIG. 8 is a schematic view of a hair styling apparatus according to a seventh embodiment.
Figure 7:
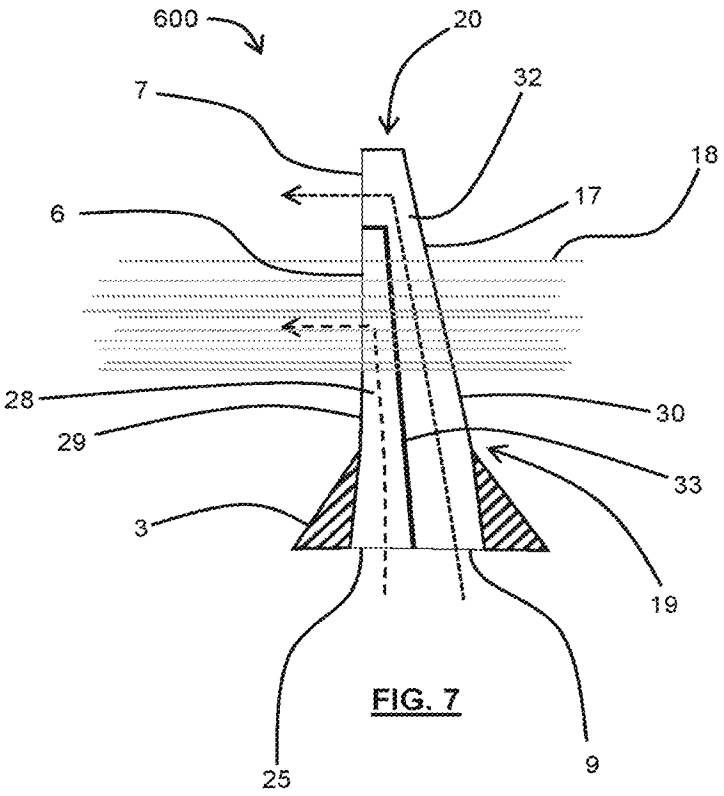
FIG. 7 is a schematic view of a hair styling apparatus according to a sixth embodiment.

FIGS. 7 and 8 depict two further embodiments that are similar to that of FIGS. 6A to 6C because they also include projections 17 in the form of a row of comb teeth (that could otherwise be provided as brush bristles). The schematic nature of these Figures means that only one projection 17 in the row is illustrated.

In FIG. 7, each projection 17 of the apparatus 600 defines both an airflow passage 32 and a steam flow passage 28 that extend along the length of the projection 17. The airflow passage 32 and steam flow passage 28 of each projection are separated by a central separator wall 33.

Each steam flow passage 28 extends from a steam inlet 25 to a steam outlet 6 disposed on a leading edge 29 of a respective projection 17. Each steam outlet 6 is arranged to discharge air in a forward direction from the leading edge 29 (i.e. generally perpendicular to the direction of extension of the projections 17).

Each airflow passage 32 extends from an airflow inlet 9 to an airflow outlet 7, which is disposed on a leading edge of a respective projection 17 and which is arranged to discharge air in a direction that is generally parallel to the direction of discharge of the steam. Each airflow outlet 7 is positioned distally of the steam outlet 6 provided on the same projection 17, which means an air curtain is generated by the airflow outlets 7 that is positioned distally of (i.e. with respect to the body) steam that is discharged by the steam outlets 6. Accordingly, the discharged air provides a barrier to the passage of steam in a direction away from the distal ends 20 of the projections 17.

In FIG. 8, each projection 17 of the apparatus 700 includes only a steam flow outlet 6 (i.e. unlike the previous embodiment, each projection 17 does not further include an airflow outlet). Instead, an airflow outlet 7 is provided on the body 3, proximate the proximal ends 19 of the projections 17. Although not apparent from the figure, the airflow outlet 7 is in the form of an elongate slot, that is elongate in a direction parallel to the row of projections 17 (i.e. extends in the transverse direction). The airflow outlet 7 is arranged to discharge air in a direction substantially parallel to the direction of extension of the projections 17 so as to form a blade or curtain of air that extends across the leading edges 29 of the projections 17. In other embodiments the airflow outlet 7 may direct air on an angle to the direction of extension of the projections so as to provide an air curtain or blade that is sloped relative to the leading edges 29.

In this way, the air discharged by the airflow outlet 7 provides a barrier to steam flow in a direction away from the leading edges 29. That is, the air helps to delimit a region in which the steam can be contained.

The exemplary embodiments set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

The invention claimed is:

1. A hair styling apparatus for styling hair, the hair styling apparatus comprising:

a steam generator for generating steam;

one or more steam outlets in fluid communication with the steam generator for receipt of steam therefrom, the one or more steam outlets arranged to discharge steam onto hair being styled by the hair styling apparatus in use;

an air mover for moving an airflow through the hair styling apparatus; and one or more airflow outlets in fluid communication with the air mover for receipt of an airflow therefrom, the one or more airflow outlets arranged to discharge air at or proximate to the discharged steam so as to provide a barrier to a passage of the steam; and a flow diverter moveable between:

a first position in which the flow diverter directs airflow to the one or more airflow outlets; and a second position in which the flow diverter directs airflow to the one or more steam outlets, or to one or more further airflow outlets arranged to discharge air onto hair being styled by the hair styling apparatus in use.

2. The hair styling apparatus according to claim 1, wherein the hair styling apparatus is configured to operate in:

a first mode in which steam is discharged from the one or more steam outlets and the flow diverter is in the first position; and a second mode in which steam is not discharged from the one or more steam outlets and the flow diverter is in the second position.

3. The hair styling apparatus according to claim 2, comprising a controller operatively connected to the flow diverter and the steam generator, and wherein the controller is configured to control the hair styling apparatus to enter the first and second modes.

4. The hair styling apparatus according to claim 3, comprising a user interface operatively connected to the controller, the controller configured to control the hair styling apparatus to enter the first or second mode in response to an input received from the user interface.

5. The hair styling apparatus according to claim 1, comprising a barrel having a circumferential surface about which a tress of hair can be wrapped in use, and wherein the one or more steam outlets are provided on the circumferential surface of the barrel.

6. The hair styling apparatus according to claim 5, wherein the one or more further airflow outlets are provided on the circumferential surface of the barrel.

7. The hair styling apparatus according to claim 1, comprising a body from which a plurality of spaced projections, the plurality of spaced projections being comb teeth or brush bristles for passing through a user's hair to style the user's hair and the one or more steam outlets are arranged to discharge steam into spaces between the plurality of spaced projections.

8. The hair styling apparatus according to claim 1, configured such that the airflow discharged from the one or more airflow outlets is provided substantially at or below ambient temperature.

9. The hair styling apparatus according to claim 1, configured such that the airflow discharged from the one or more further airflow outlets is provided substantially at or below ambient temperature.

10. The hair styling apparatus according to claim 1, configured to discharge steam from the one or more steam outlets and air from the one or more airflow outlets concurrently.

11. The hair styling apparatus according to claim 1, wherein the steam generator is configured to provide a steam flow rate through the one or more steam outlets of between 5 and 10 g/min.

12. The hair styling apparatus according to claim 1, wherein the air mover is configured to provide an air flow rate through the one or more airflow outlets of between 6 and 10 L/s.

* * * * *